US010458729B2

(12) United States Patent
Tateyama et al.

(10) Patent No.: US 10,458,729 B2
(45) Date of Patent: Oct. 29, 2019

(54) HEAT EXCHANGER AND HOT WATER APPARATUS

(71) Applicant: NORITZ CORPORATION, Hyogo (JP)

(72) Inventors: Masaya Tateyama, Kakogawa (JP); Satoshi Yoshida, Nishinomiya (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 15/834,831

(22) Filed: Dec. 7, 2017

(65) Prior Publication Data

US 2018/0172366 A1 Jun. 21, 2018

(30) Foreign Application Priority Data

Dec. 19, 2016 (JP) ..... 2016-245523

(51) Int. Cl.

| | |
|---|---|
| ***F28F 13/12*** | (2006.01) |
| ***F28F 1/40*** | (2006.01) |
| ***F24H 1/14*** | (2006.01) |
| ***F28F 9/02*** | (2006.01) |
| ***F28D 1/04*** | (2006.01) |
| ***F28D 1/053*** | (2006.01) |
| *F28D 21/00* | (2006.01) |

(52) U.S. Cl.

CPC ..... *F28F 13/12* (2013.01); *F24H 1/145* (2013.01); *F28D 1/0426* (2013.01); *F28D 1/05341* (2013.01); *F28D 1/05375* (2013.01); *F28F 1/40* (2013.01); *F28F 9/02* (2013.01); *F28D 2021/0024* (2013.01); *F28F 2215/04* (2013.01); *F28F 2215/14* (2013.01)

(58) Field of Classification Search

CPC .... F24H 1/145; F28D 1/0426; F28D 1/05341; F28D 1/05375; F28D 2021/0024; F28F 1/40; F28F 9/02; F28F 13/12; F28F 2215/04; F28F 2215/14

USPC ..... 122/235.17; 165/174, 109.1

See application file for complete search history.

(56) References Cited

U.S. PATENT DOCUMENTS 2,488,615 A * 11/1949 Arnold ..... F28F 1/40 138/38
2,688,986 A * 9/1954 O'Brien ..... F01P 11/08 138/38

(Continued)

FOREIGN PATENT DOCUMENTS

| | | |
|---|---|---|
| JP | H05-71842 B2 | 10/1993 |
| JP | 3687294 B2 | 8/2005 |
| JP | 2017-194226 A | 10/2017 |

*Primary Examiner* — Steven B McAllister
*Assistant Examiner* — Benjamin W Johnson
(74) *Attorney, Agent, or Firm* — Studebaker & Brackett PC

(57) ABSTRACT

A heat exchanger includes a heat transfer tube and a baffle. The baffle includes a main body portion, a first protruding portion, a second protruding portion, a first wall, and a second wall. The first protruding portion protrudes from the main body portion into a first space and the second protruding portion protrudes into a second space. The first wall includes a first protruding wall and a second protruding wall. The second wall includes a third protruding wall and a fourth protruding wall. The first protruding wall and the third protruding wall protrude into the first space and the second protruding wall and the fourth protruding wall protrude into the second space.

13 Claims, 12 Drawing Sheets

(56) References Cited

U.S. PATENT DOCUMENTS

| | | | | |
|---|---|---|---|---|
| 2,691,991 | A * | 10/1954 | Schutt | F01M 5/00 138/38 |
| 3,783,938 | A * | 1/1974 | Chartet | B60H 1/00321 165/166 |
| 2005/0269069 | A1* | 12/2005 | Hancock | F28D 1/0473 165/179 |
| 2015/0308756 | A1* | 10/2015 | Lee | F28F 1/32 165/109.1 |
| 2017/0307309 | A1 | 10/2017 | Negi et al. | |

* cited by examiner

FP
S1
19c
19a1
19b
19a
19c
19a1
19b
19a
19c
19a1
19b
19a

HEAT EXCHANGER AND HOT WATER APPARATUS

BACKGROUND OF THE INVENTION

Field of the Invention

The present invention relates to a heat exchanger and a hot water apparatus and particularly to a heat exchanger including a baffle and a hot water apparatus.

Description of the Background Art

A heat exchanger in which a baffle is disposed in a heat transfer tube is disclosed, for example, in Japanese Patent No. 3687294 and Japanese Patent Publication No. 5-71842. The baffle described in these publications has a part of a plate-shaped member cut and erected. The baffle promotes a turbulent flow of water and/or hot water which flows through the heat transfer tube so that thermal efficiency of the heat transfer tube is improved.

Since the baffle described in the publications rotates in the heat transfer tube when it is inserted in the heat transfer tube, it is disadvantageously difficult to assemble the baffle to the inside of the heat transfer tube.

SUMMARY OF THE INVENTION

The present invention was made in view of the problem above, and an object thereof is to provide a heat exchanger in which a turbulent flow of water and/or hot water flowing through the heat transfer tube is promoted and a baffle is readily assembled to the inside of the heat transfer tube and a hot water apparatus including the same.

A heat exchanger according to the present invention includes a heat transfer tube and a baffle. Water and/or hot water flows in an internal space in the heat transfer tube. The baffle is disposed in the internal space in the heat transfer tube and configured to promote a turbulent flow in water and/or hot water in the internal space. The baffle includes a main body portion, a first protruding portion, a second protruding portion, a first wall, and a second wall. The main body portion extends in an axial direction of the heat transfer tube and divides the internal space into a first space and a second space in a radial direction of the heat transfer tube. The first protruding portion protrudes from the main body portion into the first space. The second protruding portion protrudes from the main body portion into the second space. The first wall is connected to a first end portion of the main body portion and extends in the axial direction of the heat transfer tube. The second wall is connected to a second end portion of the main body portion and extends in the axial direction of the heat transfer tube. Each of the first protruding portion and the second protruding portion is disposed between the first wall and the second wall. The first wall includes a first protruding wall and a second protruding wall. The first protruding wall protrudes into the first space with respect to the main body portion. The second protruding wall protrudes into the second space with respect to the main body portion. The second wall includes a third protruding wall and a fourth protruding wall. The third protruding wall protrudes into the first space with respect to the main body portion. The fourth protruding wall protrudes into the second space with respect to the main body portion.

According to the heat exchanger in the present invention, the first protruding portion protruding from the main body portion into the first space and the second protruding portion protruding from the main body portion into the second space promote a turbulent flow of water and/or hot water flowing through the heat transfer tube. At the first end portion of the main body portion, the first protruding wall and the second protruding wall can be in contact with the heat transfer tube in the first space and the second space, and at the second end portion of the main body portion, the third protruding wall and the fourth protruding wall can be in contact with the heat transfer tube in the first space and the second space. Thus, rotation of the baffle in the inside of the heat transfer tube in insertion thereof in the heat transfer tube can be suppressed. Therefore, assembly of the baffle to the inside of the heat transfer tube is facilitated.

In the heat exchanger, each of the first protruding wall, the second protruding wall, the third protruding wall, and the fourth protruding wall extends in the axial direction of the heat transfer tube. Therefore, an area of contact of each of the first protruding wall, the second protruding wall, the third protruding wall, and the fourth protruding wall with the inside of the heat transfer tube in the axial direction of the heat transfer tube can be increased. Rotation of the baffle in the inside of the heat transfer tube in insertion thereof in the heat transfer tube can further be suppressed.

In the heat exchanger, the first protruding wall and the second protruding wall are equal to each other in length in the axial direction of the heat transfer tube. The third protruding wall and the fourth protruding wall are equal to each other in length in the axial direction of the heat transfer tube. Therefore, even when the heat transfer tube extends as turning back from one direction to another opposite direction, non-uniformity between a flow in one direction of water and/or hot water flowing through the heat transfer tube and a flow thereof in another direction can be suppressed.

In the heat exchanger, the first protruding wall and the third protruding wall are displaced from each other and the second protruding wall and the fourth protruding wall are displaced from each other in a direction in which the first end portion and the second end portion of the main body portion are opposed to each other. Therefore, any of the first protruding wall and the third protruding wall and any of the second protruding wall and the fourth protruding wall can be in contact with the heat transfer tube in both of the first space and the second space. Thus, rotation of the baffle in the inside of the heat transfer tube even while any one of the first protruding wall and the third protruding wall is inserted in the heat transfer tube but any the other is not inserted in the heat transfer tube can be suppressed.

In the heat exchanger, the first protruding wall and the third protruding wall face each other and the second protruding wall and the fourth protruding wall face each other in a direction in which the first end portion and the second end portion of the main body portion are opposed to each other. Therefore, while any one of a set of the first protruding wall and the third protruding wall and a set of the second protruding wall and the fourth protruding wall is inserted in the heat transfer tube but any the other set is not inserted in the heat transfer tube, contact with the heat transfer tube can be made only in one of the first space and the second space. Thus, while any one of the set of the first protruding wall and the third protruding wall and the set of the second protruding wall and the fourth protruding wall is inserted in the heat transfer tube but any the other set is not inserted in the heat transfer tube, the baffle can smoothly be inserted in the heat transfer tube.

In the heat exchanger, the first protruding portion and the second protruding portion are connected to the main body portion as being aligned in a direction in which the first end portion and the second end portion of the main body portion are opposed to each other. Therefore, at a position where the first protruding portion and the second protruding portion are connected to the main body portion as being aligned in the direction in which the first end portion and the second end portion of the main body portion are opposed to each other, a turbulent flow of water and/or hot water in both of the first space and the second space is promoted. A turbulent flow of water and/or hot water in the whole internal space is thus promoted.

In the heat exchanger, the baffle includes a first hook portion for fixation to the heat transfer tube. The first hook portion is provided in a first wall portion and a second wall portion and constructed to project to increase a distance between the first wall portion and the second wall portion from a front end portion toward a rear end portion of the baffle in the axial direction of the heat transfer tube and to thereafter decrease the distance between the first wall portion and the second wall portion. Therefore, the first hook portion can fix the baffle to the heat transfer tube. The first hook portion can elastically deform so as to decrease the distance between the first wall portion and the second wall portion while the first hook portion is inserted in the internal space in the heat transfer tube. When the first hook portion is moved out of the internal space, it is restored and can be hooked to one end surface in the axial direction of the heat transfer tube. Therefore, the baffle is readily fixed to the heat transfer tube.

In the heat exchanger, the baffle includes a second hook portion for fixation to the heat transfer tube. The second hook portion is provided in the first wall portion and the second wall portion and constructed to project to increase the distance between the first wall portion and the second wall portion in the rear end portion of the baffle and to thereafter project toward the front end portion of the baffle. Therefore, the second hook portion can fix the baffle to the heat transfer tube. Since the baffle cannot be inserted in the heat transfer tube from a side of the rear end portion due to the second hook portion, a direction of insertion of the baffle into the heat transfer tube can be restricted. Insertion of the baffle in a reverse direction can thus be prevented.

In the heat exchanger, the baffle includes a second hook portion for fixation to the heat transfer tube. The second hook portion is provided in the first wall portion and the second wall portion and constructed to project to increase the distance between the first wall portion and the second wall portion from the rear end portion toward the front end portion of the baffle in the axial direction of the heat transfer tube and to thereafter decrease the distance between the first wall portion and the second wall portion. Therefore, the second hook portion can fix the baffle to the heat transfer tube. The second hook portion can elastically deform so as to decrease the distance between the first wall portion and the second wall portion while the second hook portion is inserted in the internal space in the heat transfer tube. When the second hook portion is moved out of the internal space, it is restored and can be hooked to the other end surface in the axial direction of the heat transfer tube. Therefore, the baffle is readily fixed to the heat transfer tube. The baffle can be inserted in the inside of the heat transfer tube from any of the front end portion and the rear end portion of the baffle.

In the heat exchanger, the baffle includes a reinforcement portion which connects the first wall and the second wall to each other and is disposed at a distance from the main body portion in the axial direction of the heat transfer tube. The reinforcement portion is greater in width than the main body portion in the axial direction of the heat transfer tube. The reinforcement portion can thus reinforce the baffle.

In the heat exchanger, the internal space has an elliptical cross-section in the radial direction of the heat transfer tube. A length from a tip end of the first protruding portion in the first space to a tip end of the second protruding portion in the second space when the first protruding portion and the second protruding portion are viewed in the axial direction of the heat transfer tube is equal to or shorter than a length of a minor axis of the elliptical cross-section. Therefore, contact of the first protruding portion and the second protruding portion with the heat transfer tube in insertion of the baffle in the heat transfer tube is suppressed. The baffle is thus readily inserted in the heat transfer tube. Damage to the first protruding portion and the second protruding portion due to contact of the first protruding portion and the second protruding portion with the heat transfer tube in insertion of the baffle in the heat transfer tube can be suppressed.

A hot water apparatus according to the present invention includes the heat exchanger described above and a burner which generates a gas for heating to be supplied to the heat exchanger. According to the hot water apparatus in the present invention, a hot water apparatus including a heat exchanger in which a turbulent flow of water and/or hot water flowing through the heat transfer tube is promoted and a baffle is readily assembled to the inside of the heat transfer tube can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described below with reference to the drawings.

A construction of a hot water apparatus in one embodiment of the present invention will initially be described with reference to FIG. 1.

Figure 1:
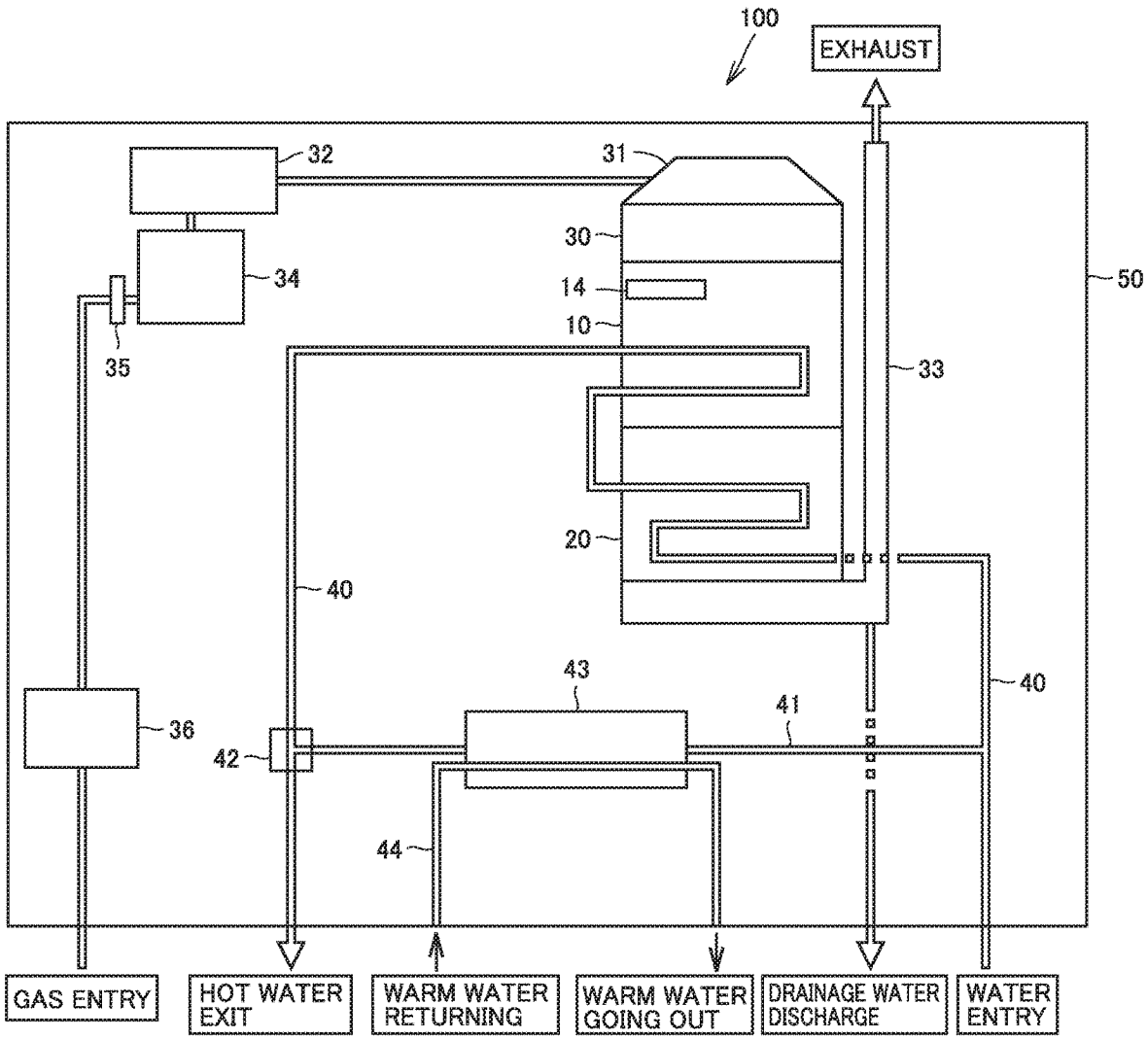
FIG. 1 is a diagram schematically showing a construction of a hot water apparatus in one embodiment of the present invention.

As shown in FIG. 1, a hot water apparatus 100 in the present embodiment mainly includes a sensible heat recovery heat exchanger (primary heat exchanger) 10, an ignition plug 14, a latent heat recovery heat exchanger (secondary heat exchanger) 20, a burner 30, a chamber 31, a fan assembly 32, a duct 33, a venturi 34, an orifice 35, a gas valve 36, a pipe 40, a bypass pipe 41, a three-way valve 42, a liquid to liquid heat exchanger 43, a hydronic pipe 44, and a housing 50. All of components except for housing 50 among the components above are disposed in housing 50. The components are similar to those which have conventionally been known, except for sensible heat recovery heat exchanger (primary heat exchanger) 10.

A fuel gas flows to venturi 34 through gas valve 36 and orifice 35. A mixture gas mixed in venturi 34 is sent to fan assembly 32. Fan assembly 32 is configured to supply the mixture gas to burner 30.

Fan assembly 32 is connected to chamber 31 and chamber 31 is connected to burner 30. The mixture gas supplied from fan assembly 32 is sent through chamber 31 to burner 30.

Burner 30 is configured to generate a gas for heating to be supplied to sensible heat recovery heat exchanger (heat exchanger) 10. The mixture gas issued from burner 30 is ignited by ignition plug 14 and becomes the combustion gas.

Burner 30, sensible heat recovery heat exchanger 10, and latent heat recovery heat exchanger 20 are connected such that the combustion gas sequentially passes through sensible heat recovery heat exchanger 10 and latent heat recovery heat exchanger 20 and exchanges heat with water and/or hot water. Duct 33 is connected to latent heat recovery heat exchanger 20 and duct 33 extends to the outside of housing 50. The combustion gas which has passed through latent heat recovery heat exchanger 20 is thus emitted to the outside of housing 50 through duct 33.

A part of pipe 40 on a hot water exit side relative to sensible heat recovery heat exchanger 10 and bypass pipe 41 are connected to each other by three-way valve 42. Liquid to liquid heat exchanger 43 is connected to bypass pipe 41. As warm water which flows in liquid to liquid heat exchanger 43 flows outside hydronic pipe 44, heat can be exchanged between warm water which flows in liquid to liquid heat exchanger 43 and warm water which flows in hydronic pipe 44.

A construction of sensible heat recovery heat exchanger (heat exchanger) 10 included in hot water apparatus 100 will now be described with reference to FIGS. 2 to 4.

Figure 2:
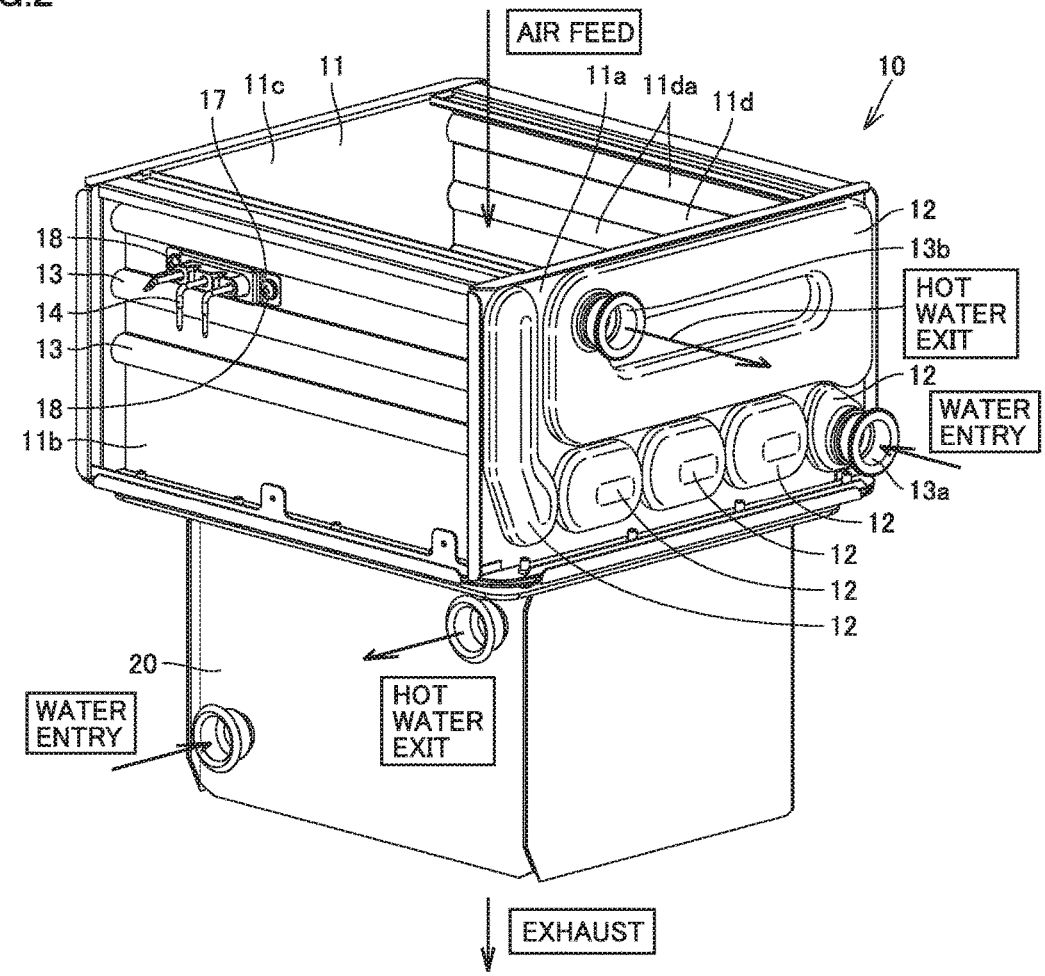
FIG. 2 is a perspective view schematically showing a construction of a sensible heat recovery heat exchanger and a latent heat recovery heat exchanger in one embodiment of the present invention.

As shown in FIG. 2, sensible heat recovery heat exchanger 10 in the present embodiment mainly includes a case 11, a header 12, a heat transfer tube (heat absorption pipe: FIGS. 3 and 4) 13, a fin 16 (FIG. 4), a pressing member 17, a fixing member 18, and a baffle 19 (FIG. 4).

Case 11 includes a first sidewall 11*a*, a second sidewall 11*b*, a third sidewall 11*c*, and a fourth sidewall 11*d*. First sidewall 11*a* to fourth sidewall 11*d* are connected to form a quadrangular frame.

Case 11 in a form of the frame opens upward and downward. The combustion gas can thus be supplied to the inside of case 11 through the upper opening of case 11. The combustion gas can be exhausted to the outside of case 11 through the lower opening of case 11.

Header 12 is provided on an outer surface of first sidewall 11*a*. A joint 13*a* on a water entry side and a joint 13*b* on the hot water exit side are attached to header 12 provided on the outer surface of first sidewall 11*a*. A not-shown header 12 is provided also on an outer surface of third sidewall 11*c*.

Figure 3:
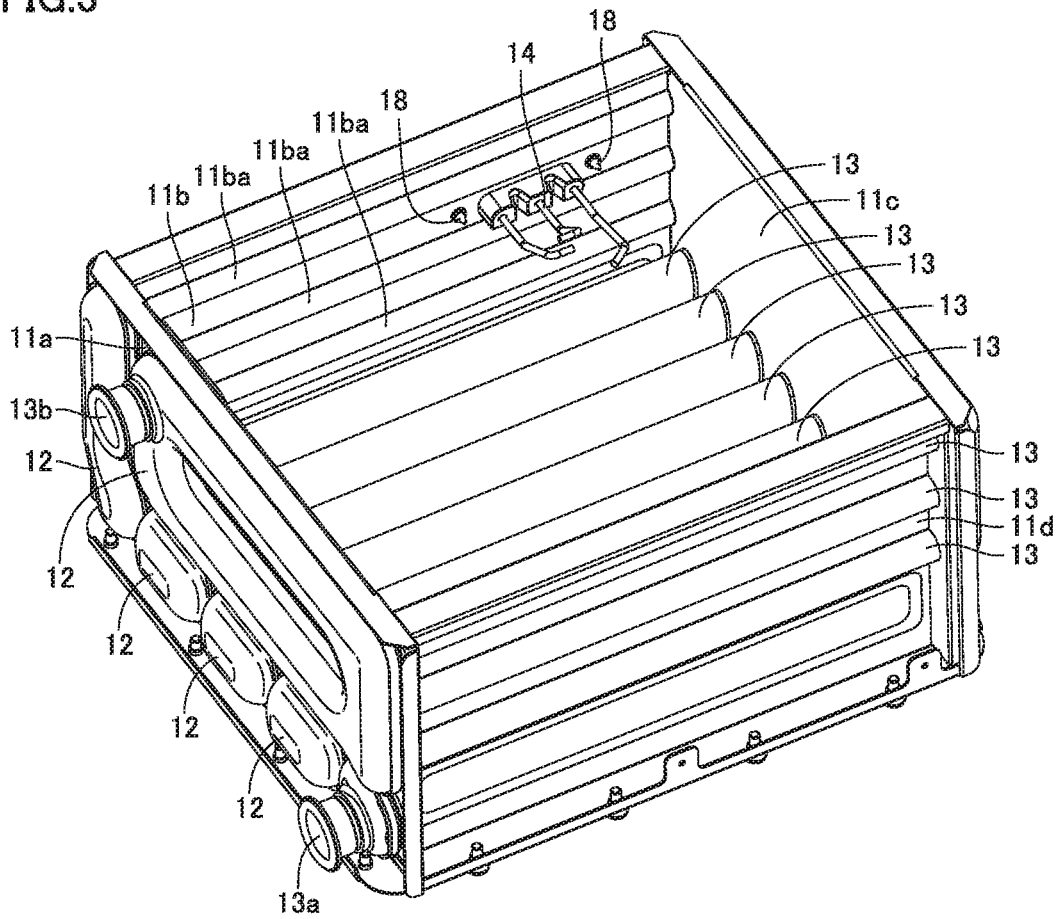
FIG. 3 is a perspective view schematically showing the construction of the sensible heat recovery heat exchanger in one embodiment of the present invention.

As shown in FIG. 3, header 12 provided on the outer surface of first sidewall 11*a* and header 12 provided on the outer surface of third sidewall 11*c* are connected to each other through a plurality of heat transfer tubes 13. The plurality of heat transfer tubes 13 include heat transfer tubes 13 located in the inside of case 11 and heat transfer tubes 13 located outside case 11.

Figure 4:
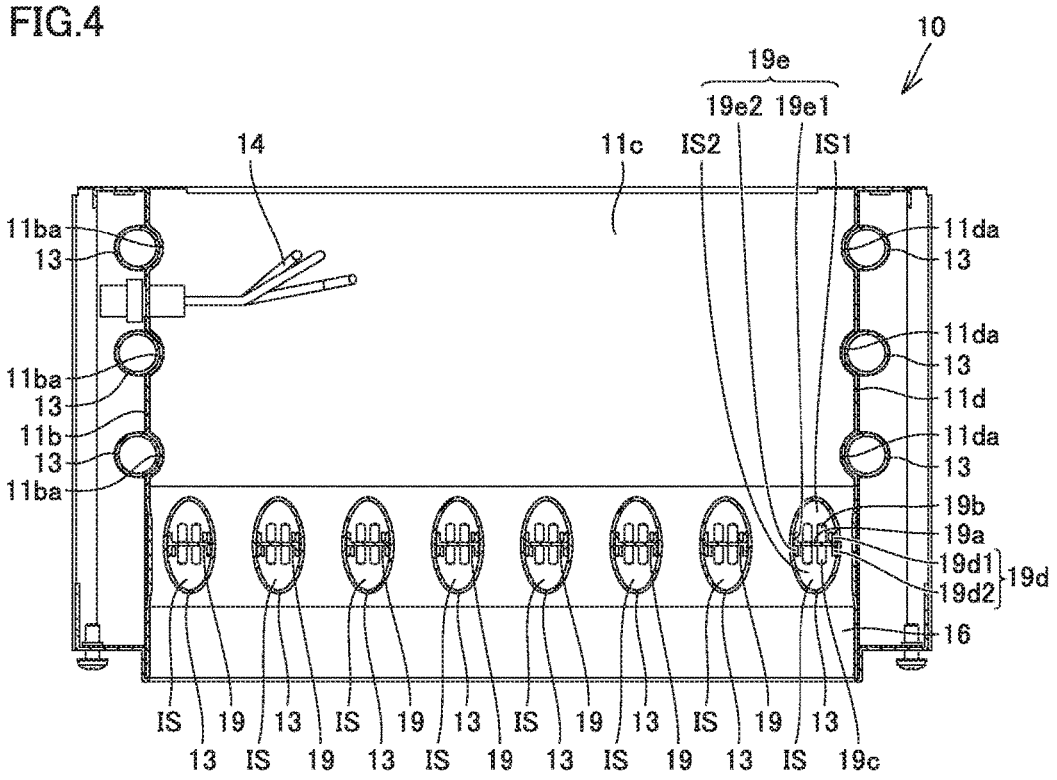
FIG. 4 is a cross-sectional view schematically showing a construction of the sensible heat recovery heat exchanger in one embodiment of the present invention.

As shown in FIG. 4, heat transfer tube 13 is configured to allow water and/or hot water to flow in an internal space IS. In the present embodiment, heat transfer tube 13 is an elliptical tube. Internal space IS has an elliptical cross-section in a radial direction of heat transfer tube 13.

Baffle 19 is disposed in internal space IS in heat transfer tube 13. Baffle 19 is configured to promote a turbulent flow in water and/or hot water in internal space IS in heat transfer tube 13. In the present embodiment, each of a plurality of baffles 19 is disposed in internal space IS in each of the plurality of heat transfer tubes 13 located in case 11.

A flow of water and/or hot water which flows through headers 12 and heat transfer tubes 13 is, for example, as follows.

Water and/or hot water which comes in from joint 13*a* on the water entry side enters heat transfer tube 13 located in the inside of case 11 through header 12 provided on a side closest to one end of the outer surface of first sidewall 11*a*. Water and/or hot water which enters heat transfer tube 13 reaches not-shown header 12 provided on the outer surface of third sidewall 11*c*. Water and/or hot water which reaches header 12 provided on the outer surface of third sidewall 11*c* reaches header 12 provided on the outer surface of first sidewall 11*a* through another heat transfer tube 13 connected to header 12.

Thus, water and/or hot water moves from a side of first sidewall 11*a* toward third sidewall 11*c* and thereafter turns back from the side of third sidewall 11*c* toward first sidewall 11*a*. Thereafter, water and/or hot water flows as repeating turning back toward third sidewall 11*c* and turning back toward first sidewall 11*a*.

As shown in FIG. 2, water and/or hot water which reaches header 12 provided on a side closest to the other end of the outer surface of first sidewall 11*a* reaches header 12 provided on the outer surface of third sidewall 11*c* through heat transfer tube 13 provided on an outer surface of second sidewall 11*b*.

As shown in FIG. 3, water and/or hot water which reaches header 12 provided on the outer surface of third sidewall 11*c* reaches header 12 provided on the outer surface of first sidewall 11*a* through heat transfer tube 13 provided on an outer surface of fourth sidewall 11*d* and finally exits from joint 13*b* on the side of hot water.

As shown in FIG. 4, a plurality of fins 16 are connected to outer circumferential surfaces of heat transfer tubes 13 located in the inside of case 11. FIG. 3 does not show fins for the sake of brevity of description.

Baffle 19 will now be described in further detail with reference to FIGS. 4 to 10.

Figure 6:
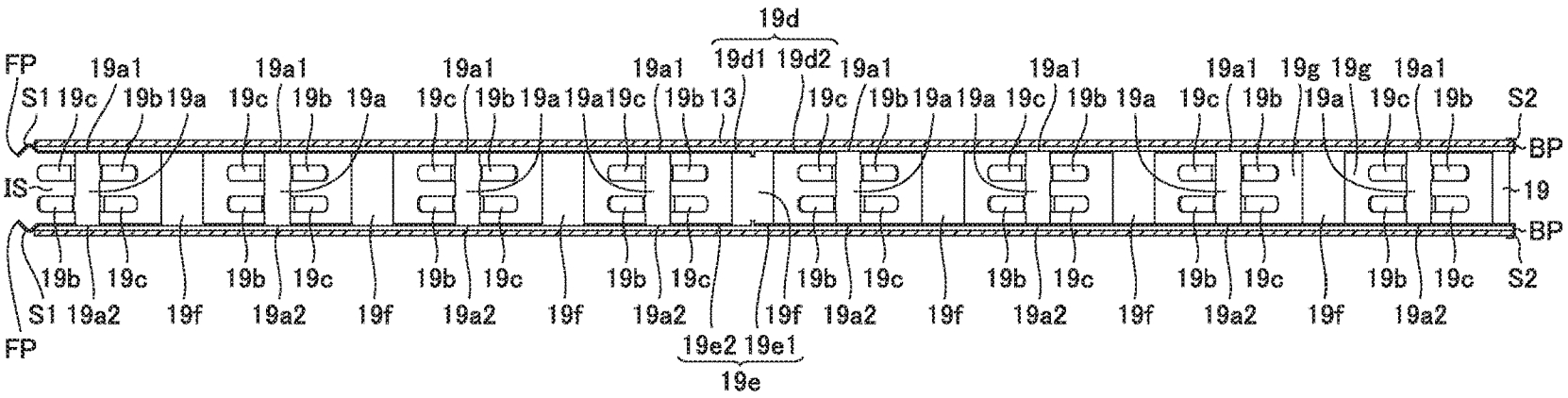
FIG. 6 is a cross-sectional view showing a state of attachment of the baffle to the heat transfer tube in one embodiment of the present invention.

As shown in FIGS. 4 and 6, baffle 19 includes a main body portion 19*a*, a first protruding portion 19*b*, a second protruding portion 19*c*, a first wall 19*d*, a second wall 19*e*, a reinforcement portion 19*f*, and an opening 19*g*. In the present embodiment, baffle 19 includes a plurality of main body portions 19*a*, a plurality of first protruding portions 19*b*, a plurality of second protruding portions 19*c*, a plurality of reinforcement portions 19*f*, and a plurality of openings 19*g*.

Main body portion 19*a* extends in the axial direction of heat transfer tube 13. Main body portion 19*a* divides internal space IS into a first space IS1 and a second space IS2 in the radial direction of heat transfer tube 13. Main body portion 19*a* is constructed in a form of a flat plate. Main body portion 19*a* has a constant width in the axial direction of heat transfer tube 13.

First protruding portion 19*b* protrudes from main body portion 19*a* into first space IS1 (one side of internal space IS). Second protruding portion 19*c* protrudes from main body portion 19*a* into second space IS2 (the other side of internal space IS). First protruding portion 19*b* and second protruding portion 19*c* protrude in a direction diagonal to the centerline in the axial direction of heat transfer tube 13.

Each of first protruding portion 19*b* and second protruding portion 19*c* is disposed between first wall 19*d* and second wall 19*e*. First protruding portion 19*b* and second protruding portion 19*c* are connected to main body portion 19*a* as being aligned in a direction in which a first end portion 19*a*1 and a second end portion 19*a*2 of main body portion 19*a* are opposed to each other. At a position intermediate in a direction of a short side of baffle 19, directions of protrusion of first protruding portion 19*b* and second protruding portion 19*c* with respect to main body portion 19*a* are reversed. In the axial direction of heat transfer tube 13, first protruding portion 19*b* and second protruding portion 19*c* are connected to respective opposing sides of one main body portion 19*a*.

First wall 19*d* is connected to first end portion 19*a*1 of main body portion 19*a*. First wall 19*d* extends in the axial direction of heat transfer tube 13. First wall 19*d* has a first protruding wall 19*d*1 and a second protruding wall 19*d*2. First protruding wall 19*d*1 protrudes from main body portion 19*a* into first space IS1. Second protruding wall 19*d*2 protrudes from main body portion 19*a* into second space IS2.

Second wall 19*e* is connected to second end portion 19*a*2 of main body portion 19*a*. Second wall 19*e* extends in the axial direction of heat transfer tube 13. Second wall 19*e* has a third protruding wall 19*e*1 and a fourth protruding wall 19*e*2. Third protruding wall 19*e*1 protrudes from main body portion 19*a* into first space IS1. Fourth protruding wall 19*e*2 protrudes from main body portion 19*a* into second space IS2.

Main body portion 19*a*, reinforcement portion 19*f*, and opening 19*g* are disposed as being aligned in the axial direction of heat transfer tube 13. Reinforcement portion 19*f* connects first wall 19*d* and second wall 19*e* to each other. Reinforcement portion 19*f* is disposed at a distance from main body portion 19*a* in the axial direction of heat transfer tube 13. Reinforcement portion 19*f* is greater in width than main body portion 19*a* in the axial direction of heat transfer tube 13. Reinforcement portion 19*f* is disposed between two main body portions 19*a* adjacent in the axial direction of heat transfer tube 13.

Opening 19*g* is disposed between main body portion 19*a* and reinforcement portion 19*f* in the axial direction of heat transfer tube 13. Opening 19*g* passes through main body portion 19*a* and reinforcement portion 19*f* in a direction of thickness of each of them. First space IS1 and second space IS2 in heat transfer tube 13 communicate with each other through opening 19*g*.

Figure 5:
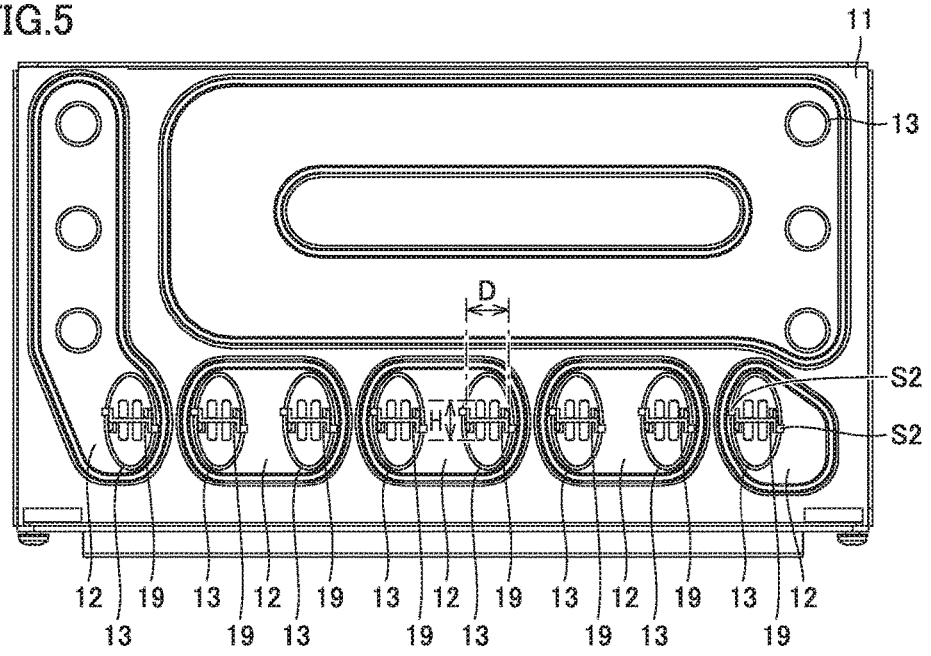
FIG. 5 is a cross-sectional view showing a state of attachment of a baffle to an end portion of a heat transfer tube in one embodiment of the present invention.

As shown in FIGS. 4 and 5, a length H from a tip end of first protruding portion 19*b* in first space IS1 to a tip end of second protruding portion 19*c* in second space IS2 when first protruding portion 19*b* and second protruding portion 19*c* are viewed in the axial direction of heat transfer tube 13 is equal to or shorter than a length of a minor axis D of the elliptical cross-section of heat transfer tube 13.

Figure 9:
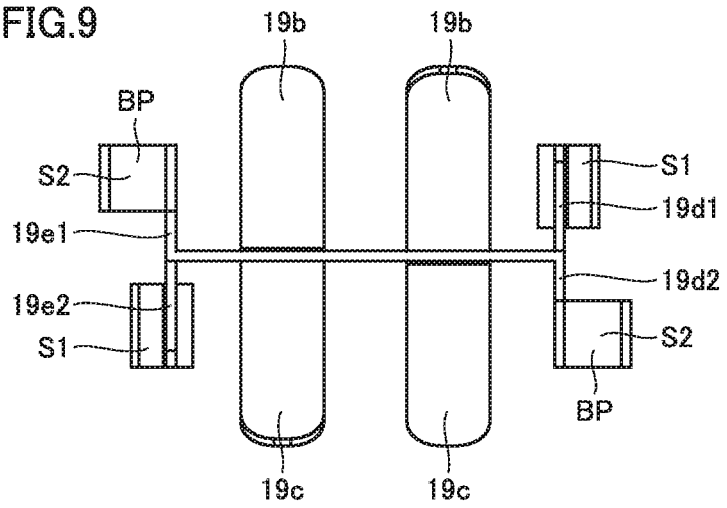
FIG. 9 is a front view schematically showing the construction of the baffle in one embodiment of the present invention.

As shown in FIGS. 5 and 9, first protruding portion 19*b* is greater in height than first protruding wall 19*d*1 and third protruding wall 19*e*1 when first protruding portion 19*b* is viewed in the axial direction of heat transfer tube 13. Second protruding portion 19*c* is greater in height than second protruding wall 19*d*2 and fourth protruding wall 19*e*2 when second protruding portion 19*c* is viewed in the axial direction of heat transfer tube 13.

Figure 7:
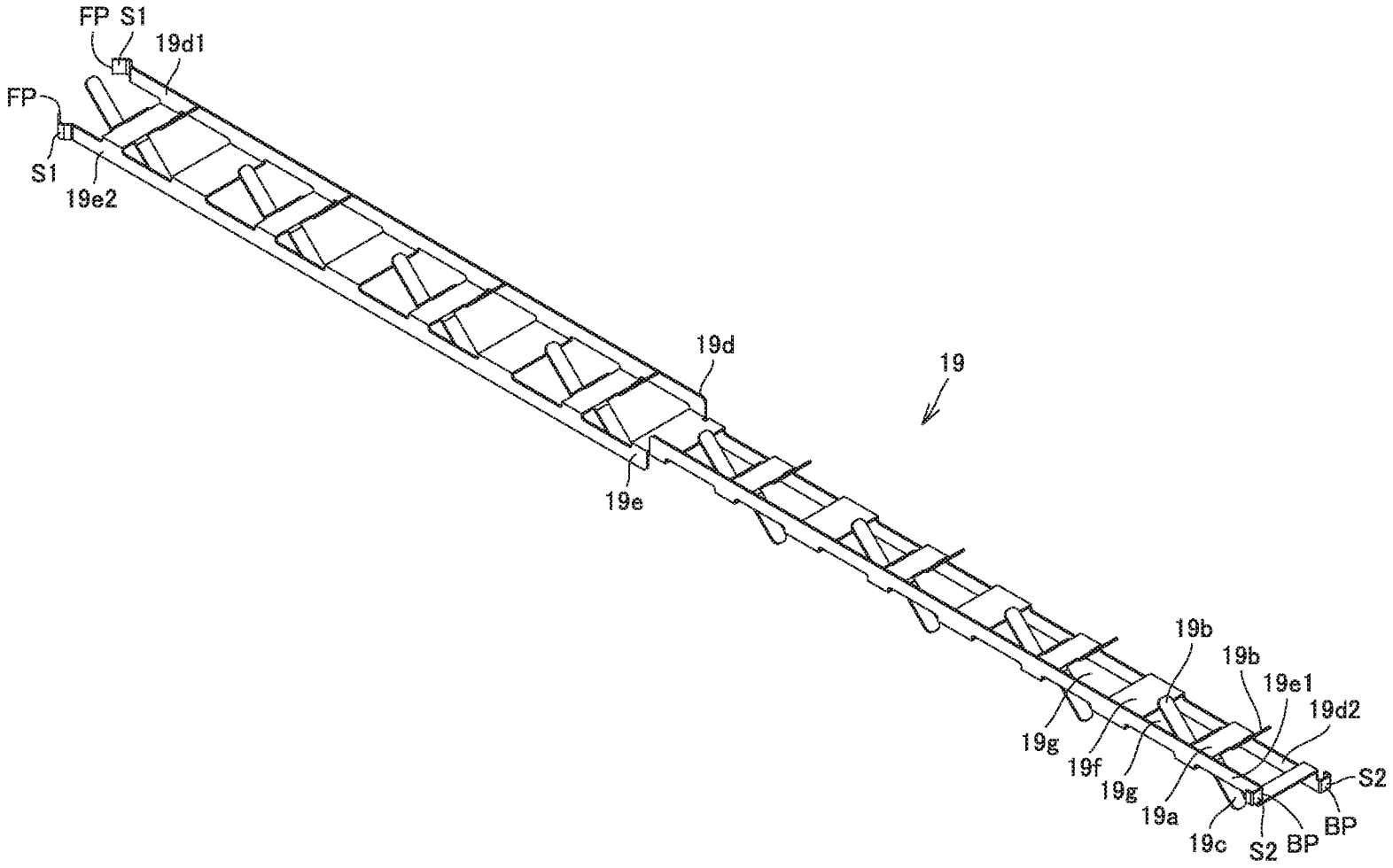
FIG. 7 is a perspective view schematically showing a construction of the baffle in one embodiment of the present invention.

As shown in FIGS. 6 and 7, each of first protruding wall 19*d*1, second protruding wall 19*d*2, third protruding wall 19*e*1, and fourth protruding wall 19*e*2 extends in the axial direction of heat transfer tube 13. In a direction in which first end portion 19*a*1 and second end portion 19*a*2 of main body portion 19*a* are opposed to each other, first protruding wall 19*d*1 and third protruding wall 19*e*1 are displaced from each other and second protruding wall 19*d*2 and fourth protruding wall 19*e*2 are displaced from each other. At a position intermediate in a longitudinal direction of baffle 19, directions of protrusion of first wall 19*d* and second wall 19*e* with respect to main body portion 19*a* are reversed.

Figure 8:
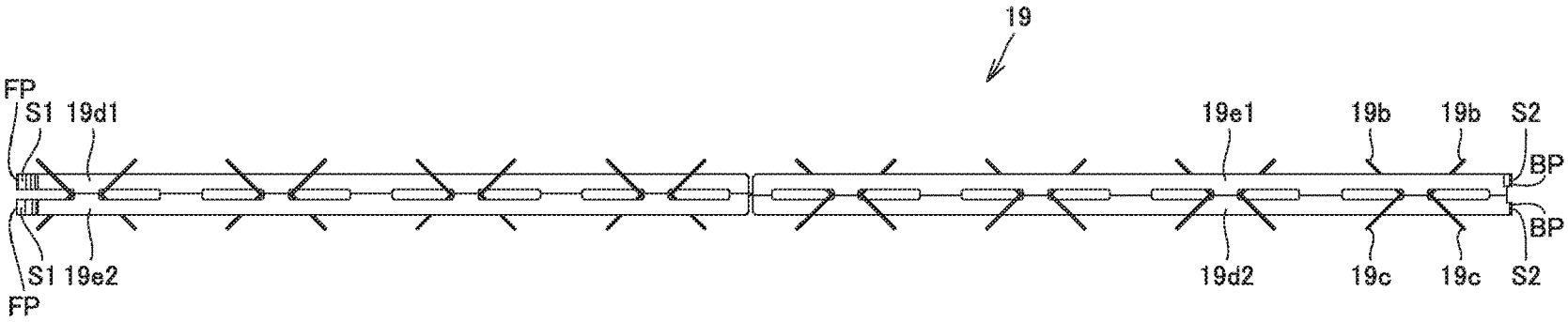
FIG. 8 is a side view schematically showing the construction of the baffle in one embodiment of the present invention.

As shown in FIGS. 6 and 8, first protruding wall 19*d*1 and second protruding wall 19*d*2 are equal to each other in length in the axial direction of heat transfer tube 13. Third protruding wall 19*e*1 and fourth protruding wall 19*e*2 are equal to each other in length in the axial direction of heat transfer tube 13.

As shown in FIGS. 6 and 7, baffle 19 has a first hook portion S1 for fixation to heat transfer tube 13. First hook portion S1 is provided in a front end portion FP of baffle 19 in the axial direction of heat transfer tube 13. First hook portion S1 is provided in first wall 19*d* and second wall 19*e*. First hook portion S1 is constructed to project to increase a distance between first wall 19*d* and second wall 19*e* from front end portion FP toward a rear end portion BP of baffle 19 in the axial direction of heat transfer tube 13 and to thereafter decrease the distance between first wall 19*d* and second wall 19*e*. First hook portion S1 is hooked to one end surface of heat transfer tube 13 in the axial direction of heat transfer tube 13. On a side of front end portion FP of baffle 19, main body portion 19*a* is not formed between end portions of first protruding wall 19*d*1 and fourth protruding wall 19*e*2.

As shown in FIGS. 5 and 6, baffle 19 has a second hook portion S2 for fixation to heat transfer tube 13. Second hook portion S2 is provided in rear end portion BP of baffle 19 in the axial direction of heat transfer tube 13. As shown in FIGS. 6 and 7, second hook portion S2 is provided in first wall 19*d* and second wall 19*e*. Second hook portion S2 is constructed to project to increase the distance between first wall 19*d* and second wall 19*e* in rear end portion BP of baffle 19 and to thereafter project toward front end portion FP of baffle 19. Second hook portion S2 is hooked to the other end surface of heat transfer tube 13 in the axial direction of heat transfer tube 13. On a side of rear end portion BP of baffle 19, main body portion 19*a* is formed also between end portions of second protruding wall 19*d*2 and third protruding wall 19*e*1.

Figure 10:
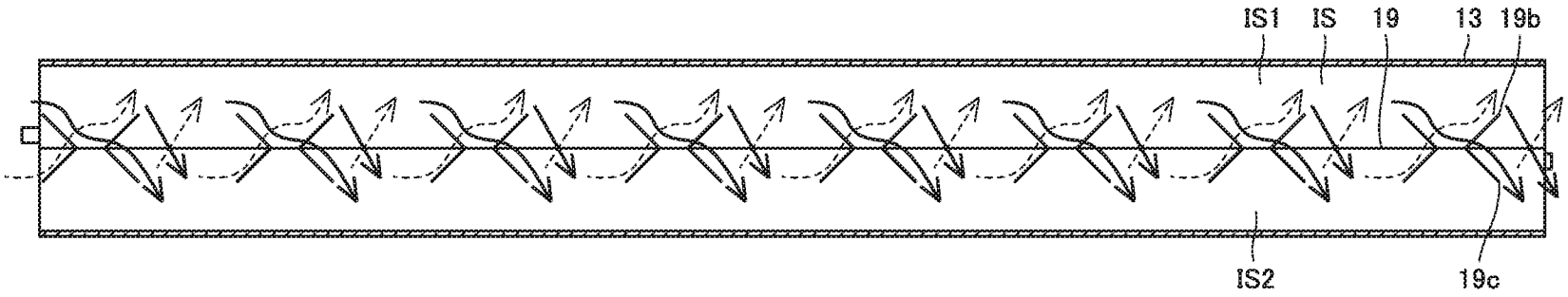
FIG. 10 is a cross-sectional view schematically showing a flow of water and/or hot water in the inside of the heat transfer tube in one embodiment of the present invention.

As shown in FIGS. 6 and 10, some of water and/or hot water flowing through heat transfer tube 13 flows as meandering through first space IS1 and second space IS2 in heat transfer tube 13 through openings 19*g* in baffle 19. In first space IS1 in internal space IS in heat transfer tube 13, a turbulent flow of water and/or hot water flowing through heat transfer tube 13 is promoted by first protruding portions 19*b*. In second space IS2 in internal space IS in heat transfer tube 13, a turbulent flow of water and/or hot water flowing through heat transfer tube 13 is promoted by second protruding portions 19*c*.

Functions and effects of the present embodiment will now be described.

According to sensible heat recovery heat exchanger (heat exchanger) 10 in the present embodiment, first protruding portion 19*b* protruding from main body portion 19*a* of baffle 19 into first space IS1 and second protruding portion 19*c* protruding from main body portion 19*a* into second space IS2 promote a turbulent flow of water and/or hot water flowing through heat transfer tube 13. At first end portion 19*a*1 of main body portion 19*a*, first protruding wall 19*d*1 and second protruding wall 19*d*2 can be in contact with heat transfer tube 13 in first space IS1 and second space IS2, and at second end portion 19*a*2 of main body portion 19*a*, third protruding wall 19*e*1 and fourth protruding wall 19*e*2 can be in contact with heat transfer tube 13 in first space IS1 and second space IS2. Thus, rotation of baffle 19 in heat transfer tube 13 in insertion thereof in heat transfer tube 13 is suppressed. Therefore, assembly of baffle 19 to the inside of heat transfer tube 13 is facilitated.

According to sensible heat recovery heat exchanger (heat exchanger) 10 in the present embodiment, each of first protruding wall 19*d*1, second protruding wall 19*d*2, third protruding wall 19*e*1, and fourth protruding wall 19*e*2 extends in the axial direction of heat transfer tube 13. Therefore, an area of contact of each protruding wall with the inside of heat transfer tube 13 in the axial direction of heat transfer tube 13 can be increased. Rotation of baffle 19 in heat transfer tube 13 in insertion thereof in heat transfer tube 13 is thus further suppressed.

According to sensible heat recovery heat exchanger (heat exchanger) 10 in the present embodiment, first protruding wall 19*d*1 and second protruding wall 19*d*2 are equal to each other in length in the axial direction of heat transfer tube 13 and third protruding wall 19*e*1 and fourth protruding wall 19*e*2 are equal to each other in length in the axial direction of heat transfer tube 13. Therefore, even when heat transfer tube 13 extends as turning back from one direction to another opposite direction, non-uniformity between a flow in one direction of water and/or hot water flowing through heat transfer tube 13 and a flow thereof in another direction can be suppressed.

According to sensible heat recovery heat exchanger (heat exchanger) 10 in the present embodiment, first protruding wall 19*d*1 and third protruding wall 19*e*1 are displaced from each other and second protruding wall 19*d*2 and fourth protruding wall 19*e*2 are displaced from each other in a direction in which first end portion 19*a*1 and second end portion 19*a*2 of main body portion 19*a* are opposed to each other. Therefore, any of first protruding wall 19*d*1 and third protruding wall 19*e*1 and any of second protruding wall 19*d*2 and fourth protruding wall 19*e*2 can be in contact with heat transfer tube 13 in both of first space IS1 and second space IS2. Thus, rotation of baffle 19 in heat transfer tube 13 even while any one of first protruding wall 19*d*1 and third protruding wall 19*e*1 is inserted in the heat transfer tube but any the other is not inserted in heat transfer tube 13 is suppressed.

According to sensible heat recovery heat exchanger (heat exchanger) 10 in the present embodiment, first protruding portion 19*b* and second protruding portion 19*c* are connected to main body portion 19*a* as being aligned in a direction in which first end portion 19*a*1 and second end portion 19*a*2 of main body portion 19*a* are opposed to each other. Therefore, at a position where first protruding portion 19*b* and second protruding portion 19*c* are connected to main body portion 19*a*, a turbulent flow of water and/or hot water in both of first space IS1 and second space IS2 is promoted. A turbulent flow of water and/or hot water in whole internal space IS is thus promoted.

According to sensible heat recovery heat exchanger (heat exchanger) 10 in the present embodiment, first hook portion S1 can fix baffle 19 to heat transfer tube 13. First hook portion S1 can elastically deform to increase the distance between first wall 19*d* and second wall 19*e* while the first hook portion is inserted in internal space IS in heat transfer tube 13. When the first hook portion is moved out of internal space IS, it is restored and can be hooked to one end surface in the axial direction of heat transfer tube 13. Therefore, baffle 19 is readily fixed to heat transfer tube 13. Since main body portion 19*a* is not formed between end portions of first protruding wall 19*d*1 and fourth protruding wall 19*e*2 on the side of front end portion FP of baffle 19, elastic deformation is easy.

According to sensible heat recovery heat exchanger (heat exchanger) 10 in the present embodiment, second hook portion S2 can fix baffle 19 to heat transfer tube 13. Since baffle 19 cannot be inserted in heat transfer tube 13 from the side of rear end portion BP due to second hook portion S2, a direction of insertion of baffle 19 into heat transfer tube 13 can be restricted. Insertion of baffle 19 in a reverse direction can thus be prevented. Since main body portion 19*a* is formed also between end portions of second protruding wall 19*d*2 and third protruding wall 19*e*1 on the side of rear end portion BP of baffle 19, the end portions are less likely to elastically deform. Therefore, unintended introduction of second hook portion S2 into heat transfer tube 13 can be suppressed.

According to sensible heat recovery heat exchanger (heat exchanger) 10 in the present embodiment, since reinforcement portion 19*f* is greater in width than main body portion 19*a* in the axial direction of heat transfer tube 13, reinforcement portion 19*f* can reinforce baffle 19.

According to sensible heat recovery heat exchanger (heat exchanger) 10 in the present embodiment, a length from the tip end of first protruding portion 19*b* in first space IS1 to the tip end of second protruding portion 19*c* in second space IS2 when first protruding portion 19*b* and second protruding portion 19*c* are viewed in the axial direction of heat transfer tube 13 is equal to or shorter than a length of the minor axis of the elliptical cross-section of heat transfer tube 13. Therefore, contact of first protruding portion 19*b* and second protruding portion 19*c* with heat transfer tube 13 in insertion of baffle 19 into heat transfer tube 13 is suppressed. Baffle 19 is thus readily inserted in heat transfer tube 13. Damage to first protruding portion 19*b* and second protruding portion 19*c* due to contact of first protruding portion 19*b* and second protruding portion 19*c* with heat transfer tube 13 in insertion of baffle 19 into heat transfer tube 13 can be suppressed.

A hot water apparatus 100 in the present embodiment includes sensible heat recovery heat exchanger (heat exchanger) 10 and burner 30 which generates a gas for heating to be supplied to sensible heat recovery heat exchanger (heat exchanger) 10. According to hot water apparatus 100 in the present embodiment, hot water apparatus 100 including sensible heat recovery heat exchanger (heat exchanger) 10 in which a turbulent flow of water and/or hot water flowing through heat transfer tube 13 is promoted and baffle 19 is readily assembled to the inside of heat transfer tube 13 can be provided.

Various modifications of baffle 19 in the present embodiment will now be described with reference to FIGS. 11 to 13. Since various modifications are the same in construction as the present embodiment unless otherwise specified, the same elements have the same reference characters allotted and description thereof will not be repeated.

Figure 11:
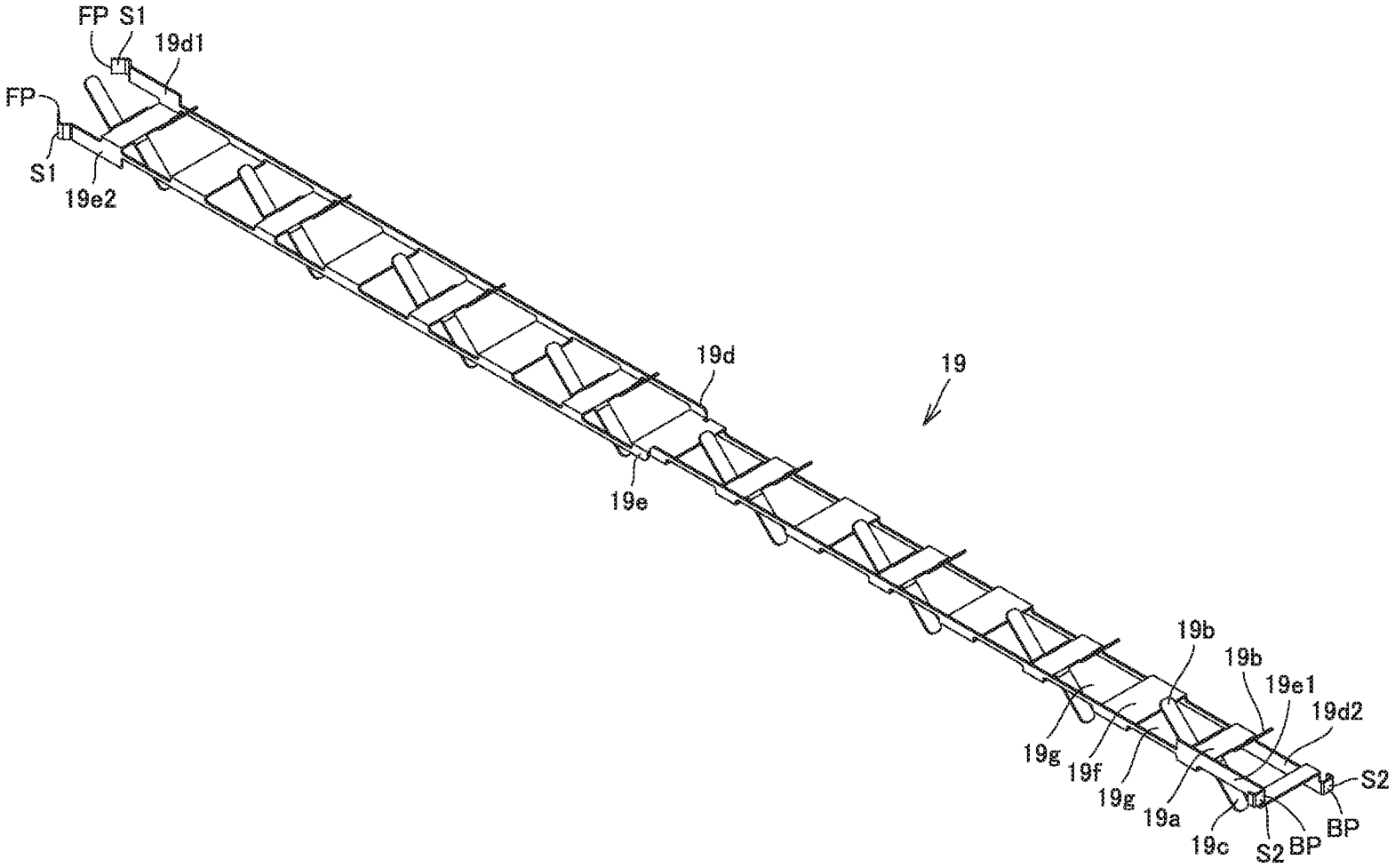
FIG. 11 is a perspective view schematically showing a construction of a first modification of the baffle.

As shown in FIG. 11, in a first modification of baffle 19, a length of first protruding wall 19*d*1, second protruding wall 19*d*2, third protruding wall 19*e*1, and fourth protruding wall 19*e*2 in the axial direction of heat transfer tube 13 is different from that in the present embodiment above. In the first modification of baffle 19, first protruding wall 19*d*1, second protruding wall 19*d*2, third protruding wall 19*e*1, and fourth protruding wall 19*e*2 are disposed at opposing end portions of baffle 19 in the axial direction of heat transfer tube 13 and not disposed in a central portion.

According to the first modification of baffle 19, since first protruding wall 19*d*1, second protruding wall 19*d*2, third protruding wall 19*e*1, and fourth protruding wall 19*e*2 are disposed in opposing end portions of baffle 19 in the axial direction of heat transfer tube 13, rotation of baffle 19 in heat transfer tube 13 in insertion thereof in heat transfer tube 13 is suppressed. Since first protruding wall 19*d*1, second protruding wall 19*d*2, third protruding wall 19*e*1, and fourth protruding wall 19*e*2 are not disposed in the central portion of baffle 19 in the axial direction of heat transfer tube 13, the central portion cannot be in contact with heat transfer tube 13. The central portion of baffle 19 can thus smoothly be inserted in heat transfer tube 13. Since each protruding wall is not disposed in the central portion of baffle 19, cost for a material for baffle 19 can be reduced.

Figure 12:
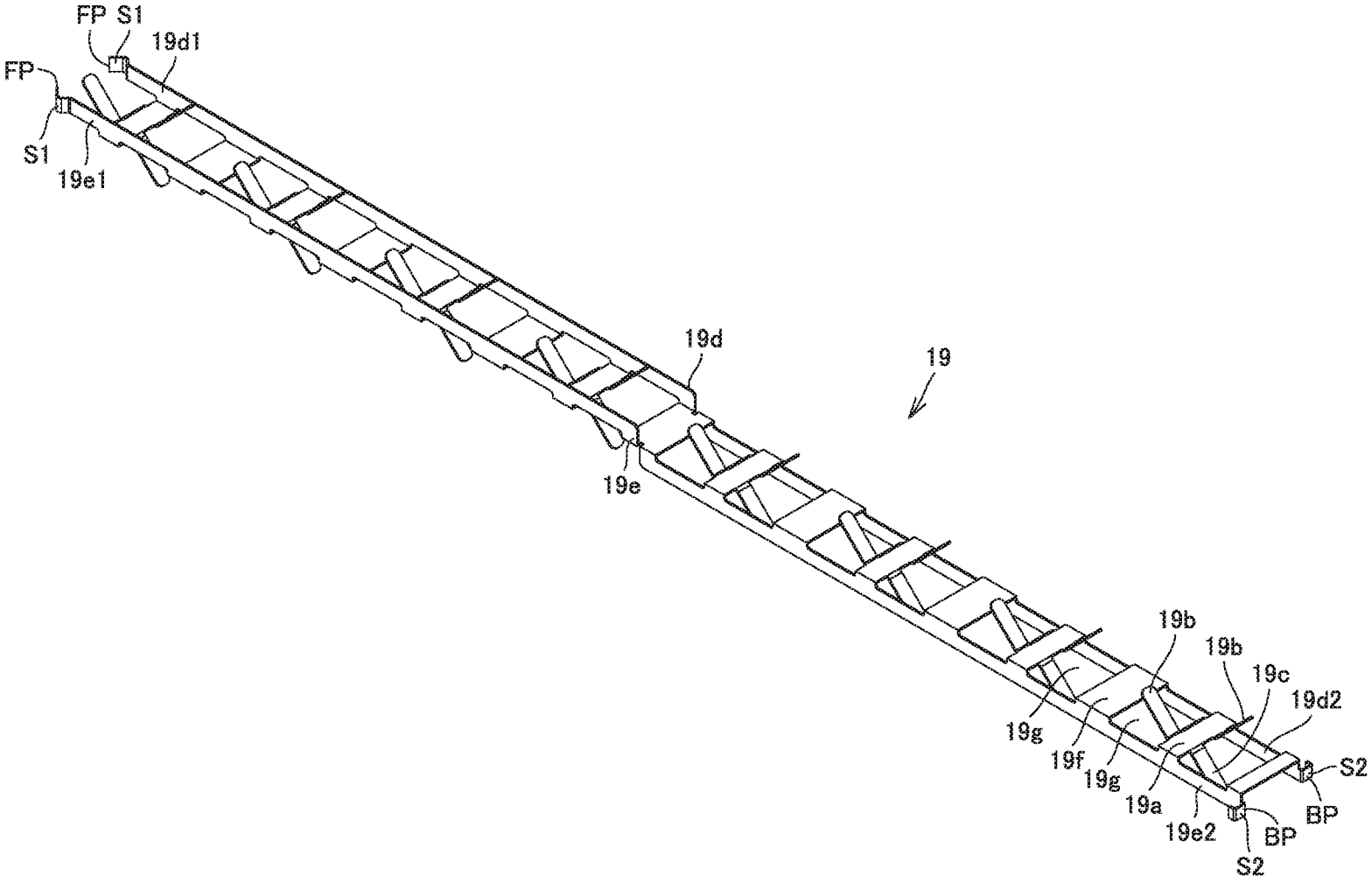
FIG. 12 is a perspective view schematically showing a construction of a second modification of the baffle.

As shown in FIG. 12, in a second modification of baffle 19, a combination of directions of protrusion of first protruding wall 19*d*1, second protruding wall 19*d*2, third protruding wall 19*e*1, and fourth protruding wall 19*e*2 is different from that in the embodiment above. In the second modification of baffle 19, in the direction in which first end portion 19*a*1 and second end portion 19*a*2 of main body portion 19*a* of baffle 19 are opposed to each other, first protruding wall 19*d*1 and third protruding wall 19*e*1 face each other and second protruding wall 19*d*2 and fourth protruding wall 19*e*2 face each other.

According to the second modification of baffle 19, while any one of a set of first protruding wall 19*d*1 and third protruding wall 19*e*1 and a set of second protruding wall 19*d*2 and fourth protruding wall 19*e*2 is inserted in heat transfer tube 13 but any the other set is not inserted in heat transfer tube 13, contact with heat transfer tube 13 can be made only in one of first space IS1 and second space IS2. Thus, while any one of the set of first protruding wall 19*d*1 and third protruding wall 19*e*1 and the set of second protruding wall 19*d*2 and fourth protruding wall 19*e*2 is inserted in heat transfer tube 13 but any the other set is not inserted in heat transfer tube 13, baffle 19 can smoothly be inserted in heat transfer tube 13.

Figure 13:
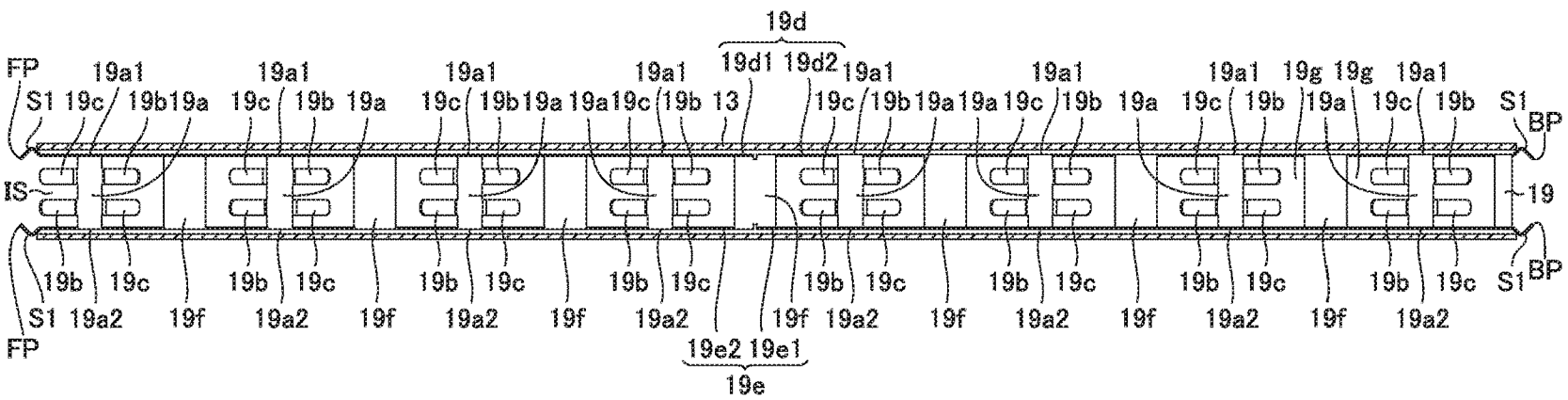
FIG. 13 is a cross-sectional view schematically showing a construction of a third modification of the baffle.

As shown in FIG. 13, in a third modification of baffle 19, a construction of second hook portion S2 is different from that in the present embodiment above. In the third modification of baffle 19, baffle 19 has second hook portion S2 for fixation to heat transfer tube 13. Second hook portion S2 is provided in rear end portion BP of baffle 19 in the axial direction of heat transfer tube 13. Second hook portion S2 is provided in first wall 19*d* and second wall 19*e*. Second hook portion S2 is constructed to project to increase the distance between first wall 19*d* and second wall 19*e* from rear end portion BP toward front end portion FP of baffle 19 in the axial direction of heat transfer tube 13 and to decrease the distance between first wall 19*d* and second wall 19*e*. Second hook portion S2 is hooked to the other end surface of heat transfer tube 13 in the axial direction of heat transfer tube 13.

According to the third modification of baffle 19, second hook portion S2 can fix baffle 19 to heat transfer tube 13. Second hook portion S2 can elastically deform to decrease the distance between first wall 19*d* and second wall 19*e* while the second hook portion is inserted in internal space IS in heat transfer tube 13. When the second hook portion is moved out of internal space IS, it is restored and can be hooked to the other end surface in the axial direction of heat transfer tube 13. Baffle 19 is thus readily fixed to heat transfer tube 13. Baffle 19 can be inserted in heat transfer tube 13 from any of front end portion FP and rear end portion BP of baffle 19.

Though an embodiment of the present invention has been described, it should be understood that the embodiment disclosed herein is illustrative and non-restrictive in every respect. The scope of the present invention is defined by the terms of the claims and is intended to include any modifications within the scope and meaning equivalent to the terms of the claims.

What is claimed is:

1. A heat exchanger comprising:

a heat transfer tube in which water and/or hot water flows in an internal space; and a baffle disposed in the internal space in the heat transfer tube, the baffle promoting a turbulent flow in the water and/or hot water in the internal space, the baffle including plural main body portions which extend in an axial direction of the heat transfer tube and divide the internal space into a first space and a second space in a radial direction of the heat transfer tube, plural first protruding portions, each of which protrudes from one of the main body portions into the first space, plural second protruding portions, each of which protrudes from one of the main body portions into the second space, a first wall connected to a first end portion of each main body portion and extending in the axial direction of the heat transfer tube, and a second wall connected to a second end portion of each main body portion and extending in the axial direction of the heat transfer tube, each of the first protruding portions and the second protruding portions being disposed between the first wall and the second wall, the first wall including a first protruding wall protruding into the first space with respect to the main body portions and a second protruding wall protruding into the second space with respect to the main body portions, and the second wall including a third protruding wall protruding into the first space with respect to the main body portions and a fourth protruding wall protruding into the second space with respect to the main body portions, wherein at least one of the first protruding wall, the second protruding wall, the third protruding wall, and the fourth protruding wall has a length in the axial direction of the heat transfer tube that exceeds at least one of a distance between consecutive first protruding portions and a distance between consecutive second protruding portions.

2. The heat exchanger according to claim 1, wherein each of the first protruding wall, the second protruding wall, the third protruding wall, and the fourth protruding wall extends in the axial direction of the heat transfer tube.

3. The heat exchanger according to claim 2, wherein the first protruding wall and the second protruding wall are equal to each other in length in the axial direction of the heat transfer tube, and the third protruding wall and the fourth protruding wall are equal to each other in length in the axial direction of the heat transfer tube.

4. The heat exchanger according to claim 1, wherein the first protruding wall and the third protruding wall are displaced from each other and the second protruding wall and the fourth protruding wall are displaced from each other in a direction in which the first end portion and the second end portion of each main body portion are opposed to each other.

5. The heat exchanger according to claim 1, wherein the first protruding wall and the third protruding wall face each other and the second protruding wall and the fourth protruding wall face each other in a direction in which the first end portion and the second end portion of each main body portion are opposed to each other.

6. The heat exchanger according to claim 1, wherein the first protruding portions and the second protruding portions are aligned in a direction in which the first end portion and the second end portion of each main body portion are opposed to each other.

7. The heat exchanger according to claim 1, wherein the baffle includes a first hook portion for fixation to the heat transfer tube, and the first hook portion is provided in the first wall and the second wall and includes a first portion that has a shape that increases a distance between the first wall and the second wall and a second portion that has a shape that decreases the distance between the first wall and the second wall, the first portion of the first hook portion being closer to a front end portion of the baffle than the second portion of the first hook portion.

8. The heat exchanger according to claim 7, wherein the baffle includes a second hook portion for fixation to the heat transfer tube, and the second hook portion is provided in the first wall and the second wall and includes a first portion that projects outwardly in the radial direction of the heat transfer tube from at least one of the first wall and the second wall and a second portion that extends from an outward most end of the first portion of the second hook portion toward the front end portion of the baffle.

9. The heat exchanger according to claim 7, wherein the baffle includes a second hook portion for fixation to the heat transfer tube, and the second hook portion is provided in the first wall and the second wall and includes a first portion that has a shape that increases the distance between the first wall and the second wall and a second portion that has a shape that decreases the distance between the first wall and the second wall, the first portion of the second hook portion being closer to a rear end portion of the baffle than the second portion of the second hook portion.

10. The heat exchanger according to claim 1, wherein the baffle includes a reinforcement portion which connects the first wall and the second wall to each other and is disposed at a distance from each main body portion in the axial direction of the heat transfer tube, and the reinforcement portion is greater in width than each main body portion in the axial direction of the heat transfer tube.

11. The heat exchanger according to claim 1, wherein the internal space has an elliptical cross-section in the radial direction of the heat transfer tube, and a length from a tip end of each first protruding portion in the first space to a tip end of each second protruding portion in the second space when the first protruding portions and the second protruding portions are viewed in the axial direction of the heat transfer tube is equal to or shorter than a length of a minor axis of the elliptical cross-section.

12. A hot water apparatus comprising:

the heat exchanger according to claim 1; and a burner which generates a gas for heating to be supplied to the heat exchanger.

13. A heat exchanger comprising:

a heat transfer tube in which water and/or hot water flows in an internal space; and a baffle disposed in the internal space in the heat transfer tube, the baffle promoting a turbulent flow in the water and/or hot water in the internal space, the baffle including plural main body portions which extend in an axial direction of the heat transfer tube and divide the internal space into a first space and a second space in a radial direction of the heat transfer tube, plural first protruding portions, each of which protrudes from one of the main body portions into the first space, plural second protruding portions, each of which protrudes from one of the main body portions into the second space, a first wall connected to a first end portion of each main body portion and extending in the axial direction of the heat transfer tube, a second wall connected to a second end portion of each main body portion and extending in the axial direction of the heat transfer tube, and a reinforcement portion disposed between two consecutive main body portions, each of the first protruding portions and the second protruding portions being disposed between the first wall and the second wall, the first wall including a first protruding wall protruding into the first space with respect to the main body portions and a second protruding wall protruding into the second space with respect to the main body portions, and the second wall including a third protruding wall protruding into the first space with respect to the main body portions and a fourth protruding wall protruding into the second space with respect to the main body portions, wherein each of the two consecutive main body portions is separated from the reinforcement portion in the axial direction of the heat transfer tube by an opening that extends an entire distance between the first wall and the second wall in a radial direction of the heat transfer tube, and at least one of the first protruding wall, the second protruding wall, the third protruding wall, and the fourth protruding wall has a length in the axial direction of the heat transfer tube that exceeds at least one of a distance between consecutive first protruding portions and a distance between consecutive second protruding portions.

* * * * *